United States Patent [19]

Shaw et al.

[11] 4,249,866

[45] Feb. 10, 1981

[54] CONTROL SYSTEM FOR SCREW COMPRESSOR

[75] Inventors: David N. Shaw, Unionville, Conn.; David J. First, Carlisle, Mass.

[73] Assignee: Dunham-Bush, Inc., West Hartford, Conn.

[21] Appl. No.: 882,468

[22] Filed: Mar. 1, 1978

[51] Int. Cl.[3] ..... F04B 49/02

[52] U.S. Cl. ..... 417/280; 417/282; 417/290; 417/310

[58] Field of Search ..... 417/280, 282, 290, 310; 418/201

[56] References Cited

U.S. PATENT DOCUMENTS

| | | | |
|---|---|---|---|
| 1,997,476 | 4/1935 | Wallene | 417/282 X |
| 2,007,388 | 7/1935 | Tarleton | 417/282 X |
| 3,936,239 | 2/1976 | Shaw | 417/310 X |
| 4,052,135 | 10/1977 | Shoop et al. | 417/310 X |
| 4,068,980 | 1/1978 | Fine et al. | 417/290 X |
| 4,076,461 | 2/1978 | Moody, Jr. et al. | 417/310 |
| 4,080,110 | 3/1978 | Szymaszek | 417/280 |

*Primary Examiner*—Leonard E. Smith
*Attorney, Agent, or Firm*—Sughrue, Rothwell, Mion, Zinn and Macpeak

[57] ABSTRACT

An electronic control system for sequential actuation of a four-way solenoid valve is used to selectively load and unload a slide valve control for a screw compressor. The electronic control system is responsive to output air pressure and pulses a four-way solenoid valve to selectively load and unload the system so that it will maintain system pressure within a preselected deadband. Selective pulsing of the four-way solenoid valve is used to gate hydraulic fluid to load and unload chambers separated by a piston coupled to a slide valve which shifts longitudinally and changes the capacity of the screw compressor. The control system senses output line pressure, and when a limit pressure is exceeded, a dump solenoid valve and fast-unload system is actuated to entirely unload the system of air pressure until reduced to a level below the set deadband. The control circuit also monitors current to the motor which drives the screw compressor. When the motor current is above a normal limit, further loading of the compressor is inhibited. If the current continues to rise, indicating a decrease in voltage available for power, the compressor is driven to an unloaded state until the current matches the preset normal limits. By use of electronic control for selective pulsing of the four-way solenoid valve, energy savings are realized by maintaining operation within a narrow deadband of operation.

27 Claims, 3 Drawing Figures

LOW PRESSURE NOMINAL PERFORMANCE CURVE

CONTROL SYSTEM FOR SCREW COMPRESSOR

BACKGROUND OF THE INVENTION

1. Field of the Invention

This invention relates to control systems for helical screw rotary compressors.

2. Prior Art

This invention is an improvement over the pneumatic and hydraulic control system which is disclosed in Application Ser. No. 531,121, now U.S. Pat. No. 4,076,461 entitled "Feedback Control System For Helical Screw Rotary Compressors." In general, such screw compressors utilize an oil-flooded rotary screw compressor assembly which is directly coupled to an electric motor for rotation of the screw elements. Compression is achieved in the compressor section by meshing of two precision rotors, rotating in opposite directions inside a compressor chamber. In such screw compressors, a suction stroke occurs as a male lobe of one rotor leaves a female pocket in another rotor during its exposure to the port inlet area. The suction continues during rotation until a cut-off at the inlet port. This volume of air is then trapped and compressed as the male lobe meshes with the female pocket, thereby continuously reducing the trapped air volume and creating a pressure increase. Continued rotation exposes the internally compressed air to a discharge port which is then forced out of the machine as the male lobe completes its final meshing with the mating pocket of the female rotor. By varying the effective length of the compressor rotor, output pressure can be varied.

Prior art control of the effective length of the compressor was achieved by means of a hydraulic cylinder and piston assembly which was coupled by hydraulic piston to a sliding valve element. By selectively driving the hydraulic piston, the valve assembly was moved to control the effective length of the male and female rotors under compression in the screw compressor, thereby controlling compressor output. Control of the hydraulic piston was by means of a pneumatically operated sequencing valve. The pneumatic valve was used to divert oil to either the inboard or outboard side of the hydraulic piston and thereby effectively shift the control valve.

One of the difficulties with this prior art arrangement was a relatively wide control range (typically, 10 psi). Conventional suction throttled equipment also requires large pressure rises to complete unloading, typically 10 psi, and such a pressure increase when added to the pressure drop associated with after-cooling, separating drying plant piping and the like, can cause a pressure increase in the range of 10–18 psi before conventional equipment is completely unloaded. In contrast, by use of electronic control over a four-way solenoid valve, power consumption is minimized because the control can maintain air header pressure constant regardless of demand. Electronic control over the system will allow the compressor discharge pressure to fall as it unloads, while header pressure can remain constant. Because the compressor is used to hold system pressure at an essentially constant level independent of compressor output, the compressor discharge pressure can actually fall at a reduced flow, thereby avoiding the 10–18 psi pressure rise which conventional pneumatic controls require to merely minimize compressor output.

Another problem with conventional equipment is that electric motors used to drive the compressor section are built in size to minimum standards. Hence, minimum size motors are conventionally used which will require larger current demand into the service factor for normal operation. This minimum sizing, when coupled with contemporary voltage cutbacks and "brown-outs", tends to shorten motor life, and in extreme cases cause burn-out. By use of solid state circuitry, a load limiter can be used to prevent the motor from drawing more power than its assigned maximum service factor rating. When the current draw exceeds a set value, the compressor will unload until it reaches a point where current draw is equal to motor service factor rating. By use of load limiters, the system can be field adjusted such that compressor output would decrease but the drive motor will not draw more current than a predetermined amount, irrespective of how high of an increase in discharge pressure is set into the system. By this technique, the use of larger motors, starters and the like is eliminated because the load limiter functions as a real time mechanism to match motor current draw with system output.

Another problem in the prior art pneumatic control technique was the fact that the pressure tap which is used to provide a sensor input to the pneumatic sequencing valve had to be located at a position near the compressor element itself. Accordingly, the sensor could not be located at a point in the system where a user wished to maintain a constant minimum pressure. By the use of the novel control electronics in the present application, a pressure sensing element can be located in the air header at a point where a constant minimum pressure is to be maintained anywhere in the installed location. By locating the pressure-sensitive element at this point, the package discharge pressure can be reduced rather than increased with decreasing load. In conventional suction throttle equipment, the control sensing line is located at a point immediately downstream of the oil separator, and as a consequence, header pressure and compressor discharge must increase to a substantial amount to unload the compressor as the demand increases. As a consequence, an excess of header pressure results in wasting compressor drive energy in the system.

SUMMARY OF THE INVENTION

Accordingly, it is an object of this invention to provide a novel electronic control circuit to sense and control the operation of a screw compressor.

It is another object of this invention to provide for an electronic control of a four-way valve which selectively is pulsed to control a hydraulic valve that selectively varies the effective length of the rotors in a screw compressor.

Yet another object of this invention is to provide a system of electronic control that monitors current requirements of the drive motor to unload the compressor when current requirements exceed set predetermined ratings of the drive motor.

Still a further object of this invention is to provide an electronic control system for a screw compressor which automatically pulses a four-way valve to maintain a predetermined deadband of operation of the screw compressor.

A further object of this invention is to provide an electronic control circuit used in conjunction with a solenoid which will automatically dump pressure in a separator tank to allow a minimum power draw in a no-load condition and also to dump the pressure in the separator tank and fast-unload the compressor when an overload condition occurs.

These and other objects of this invention are achieved in a novel control system utilizing a four-way valve which is coupled to a hydraulic piston and cylinder assembly used to move a control valve element. Essentially, oil which is used as a hydraulic fluid is introduced into either an inboard or outboard end of the hydraulic cylinder separated by the piston arrangement. Coupled to the piston is a shaft having, at the opposite end, a slide valve which shifts longitudinally to change the capacity of the screw compressor for loading or unloading. Those operations are a function of the fast and slow delivery of hydraulic fluid to either of the two chambers.

The four-way control valve acts under control of the electronic circuit which senses air pressure downstream of the separator tank. Under the control of the logic network in the control circuit, oil from a reservoir is fed into the system through an unload feed solenoid, a normally open valve, to the outboard side of the hydraulic cylinder and is bled from the inboard side by a similar solenoid. This will cause the cylinder to move to the right, thereby unloading the compressor in a fast-unload mode. Alternatively, the hydraulic working fluid can be fed under pressure through the four-way valve for controlled flow to the outboard chamber. A parallel connection in the hydraulic line allows oil to be relieved from the outboard chamber through the restrictor section (for speed control) and dumped immediately into the compressor outlet housing.

The four-way valve utilizes two operative coils, one used to perform the loading and the other used to perform the unloading function. This valve is a standard commercially available component.

The control electronics is used to regulate the action of the four-way valve and associated solenoid valve operations. Two primary inputs are utilized by the control electronics, the first being the air pressure transducer located on the main header line in the area to be controlled, and the second being the current transformer used to sense voltage requirements of the compressor motor. Inputs from the air pressure transducer are regulated to a given set point, and proportional load/unload control of pressures relative to the set point are achieved. A deadband is set together with bandwidth control to minimize cycling such that the four-way control valve tends to dither about a null position. When within the deadband, the system is locked with no pulsing action. When the air pressure transducer senses a preset over-pressure, the dump solenoid and fast-unload solenoids are actuated to relieve the system of pressure. The control electronics also utilize a time delay circuit to first drive the slide valve in an unload direction for 10 seconds after initiation of power to the unit.

Under initial start-up conditions, the pressure sensed is below the set point pressure so a load boost circuit is actuated to bring the system up to a load condition after the 10-second time delay has been achieved. As the signal level approaches the set point and the system comes within the linear deadband width, the system utilizes a comparator amplifier which compares the absolute value of the shifted pressure voltage with the output of a bandwidth adjustment. This comparator output is used to selectively load or unload the compressor and maintain it within the set bandwidth.

Because the output of the shifted voltage is an absolute value from the set point, additional circuitry is utilized to decide whether the bandwidth is either in a load or unload condition. The output of the load/unload circuitry is applied simultaneously to the logic networks used to drive the load and unload portions of the four-way valve. Hence, this circuitry applies appropriate high or low signals to the logic network to determine whether or not the instrument is operating in a load or unload mode.

A more complete description of the invention will be obtained from a review of the drawings and the description of the preferred embodiment which follow.

DESCRIPTION OF THE PREFERRED EMBODIMENT

Figure 1:
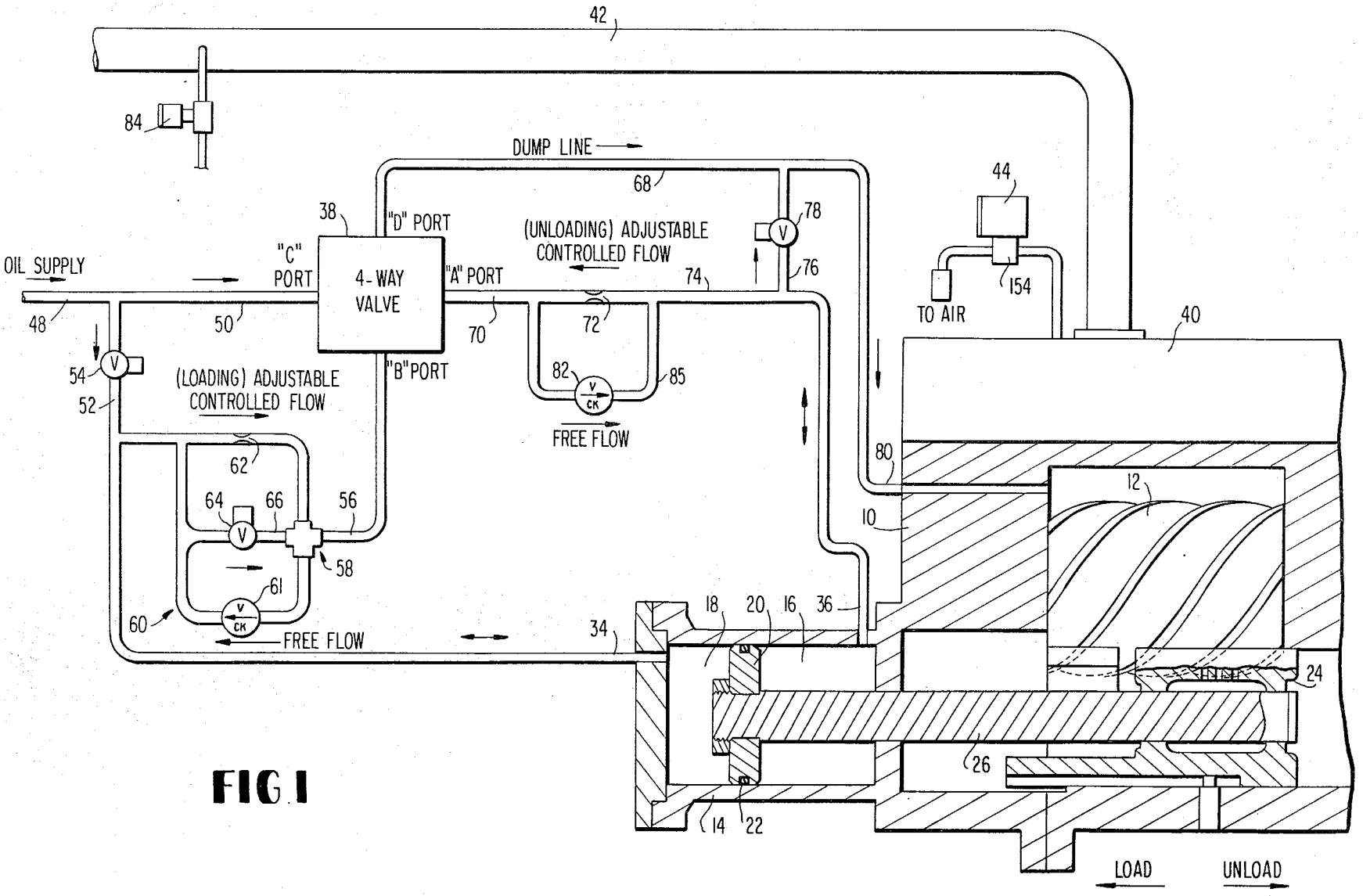
FIG. 1 is a schematic view of the overall system utilizing electronic control and a four-way valve to regulate a screw compressor.

Referring now to FIG. 1, a schematic view shows the overall component elements of the present system. A compressor screw section in housing 10 utilizes a pair of compressor rotors in a meshed relationship. One such rotor 12 is shown in the figure. A hydraulic piston and cylinder assembly is shown disposed in housing 14, comprising a cylinder chamber having inboard section 16 and outboard section 18 operably separated by piston element 20. Conventionally, a piston ring 22 is used to provide the appropriate seal between the chamber walls and the piston assembly. The hydraulic piston 20 is used to provide force to actuate slide valve 24 which moves relative to the rotor 12 varying its effective length, thereby controlling compressor output. The slide valve 24 is operably coupled to the piston by means of rod 26 which is in the form of a hollow spindle assembly. The outboard chamber 18 has a duct 34 associated with it, while the inboard end has a corresponding duct section 36. The ducts 34 and 36 will be discussed herein relative to the operation of the four-way valve structure 38 since they are in both a load and discharge mode.

By selectively gating lubricating oil into chambers 16 and 18, the piston 20 is moved from a full unload position at the extreme right to a full load position at the extreme left of slide valve 26 travel. As a consequence of this movement, the effectiveness of the rotor is varied such that the compressed air output is regulated as fed into separator tank 40. In the separator tank, lubricating oil is separated from compressed air, and the compressed air output is fed along line 42 to the main header in the system.

A separator dump solenoid valve 44 is provided to vent the separator tank to air. The separator dump solenoid valve reduces the separator pressure to allow a minimum power drain on the system when in a no-load condition. Also, when an over-pressure is sensed, the solenoid valve 44 may be operated to dump the pressure in the tank 40 to atmosphere. This valve, for safety purposes, is normally in an open position. When it is to be closed, power is applied. Hence, in case of a general power failure, all pressure will be dumped since valve 44 will remain open.

The four-way valve 38 is shown in FIG. 1 and comprises basically a two-coil structure providing selective actuation of the system. This valve is commercially available, typically a DA8347A2V manufactured by Automatic Switch Co. Oil from a reservoir is fed into inlet 48 and is tapped on line 50 to input port "C" in the valve structure. Another flow path is established on line 52, having a fast-unload feed solenoid 54. The downstream section of fast-unload feed solenoid 54 is coupled to line 34 directly to the outboard section 18 of the hydraulic cylinder. With the fast-unload feed solenoid 54 opened, oil from the reservoir flows directly from the main 48 into duct 34 to drive the power drive piston 20 to the right, thereby driving the slide valve 24 to an extreme unload position. The four-way valve 38 is bypassed in the fast-unload mode. Also, fast-unload solenoid 78 serves to bleed the inboard side of the cylinder directly to compressor suction tap 80.

Controlled flow to the outboard side is also established by means of the four-way valve by gating oil from line 50 to input port "C" and directing it outward through port "B". At output port "B", oil is directed through line 56 into cross or divider section 58. Normal free flow is established at one junction through line 60 passing through check valve 61 and then into the duct 34.

Also, as shown in FIG. 1, the other branches of cross 58 is used to provide gates from port 34 back to the "B" port. When solenoid 64 is open, oil can be diverted from the outboard side 18 of the hydraulic cylinder back through port 34, through solenoid 64 through line 66, through the cross 58 and back through the "B" port of valve 38 to "D" port. During this operation, the fast-unload solenoid 54 is closed, and during the loading, oil is passed through the "B" port of the four-way valve out through the "D" port and line 68 to eventually be fed as exhaust oil to the compressor inlet housing through line 80.

During a load mode, oil from line 50 is fed through the "C" port of the four-way valve and diverted through the "A" output port through line 70 and through check valve 82. As shown in FIG. 1, check valve 82 and restrictor 72 are identified as separate functional elements. In practice, these functions can be combined into a single valve structure providing both check valve and controlled flow functions.

A fast-unload drain is provided in the system by means of duct 76 coupled to lines 68–80. A fast-unload drain solenoid 78 is provided which, when open, provides a direct fast unload from chamber 16 through duct 36, duct 76 and directly to the compressor inlet housing along lines 68–80. In a fast-unload mode, solenoids 54 and 78 are opened so that much oil is diverted directly into chamber 18 while much is simultaneously being exhausted from chamber 16 without going through the four-way valve structure 38. Oil removed from the system is fed to the compressor housing inlet 80.

These hydraulic functions of the system shown in FIG. 1 are controlled by means of an electronic circuit to effectuate system operation in the following modes.

During start-up, a 10-second time delay is built into the system, with power turn-on and the fast-unload feed solenoid 54 actuated and all dump functions, such as dump solenoid valve 44, are closed. The system is unloaded by a fast-unload moving the valve to the right. The load boost function is also turned off. Following the 10-second delay, the system is loaded with the load boost function on and separator tank dump solenoid valve actuated to provide safety for air pressure overload. The electronic control circuit turns off the solenoid 54 to deactivate the fast-unload section. A first coil in the valve structure 38 is actuated to drive the hydraulic piston 20 to the left by feeding oil from line 50 from port "C" through port "A" and line 60 into port 36. In the load condition, control oil is fed into the inboard side 16 and exhausted from outboard side 18 via restrictor 62 and solenoid 64 through "B" to "D" in valve 38. With the load boost cycle actuated, oil discharged from outboard end 18 is fed back through line 34 through solenoid 64 and into the "B" port of the four-way valve 38.

As the pressure increases, the system builds up pressure in line 42 as sensed by transducer 84 to a load which matches demand. At this time, the slide valve 24 is moving to the left, increasing the effective length of the rotor, thereby increasing compressor output.

When demand approaches output, the load cycle is discontinued when pressures reach a lower bandwidth.

Figure 3:
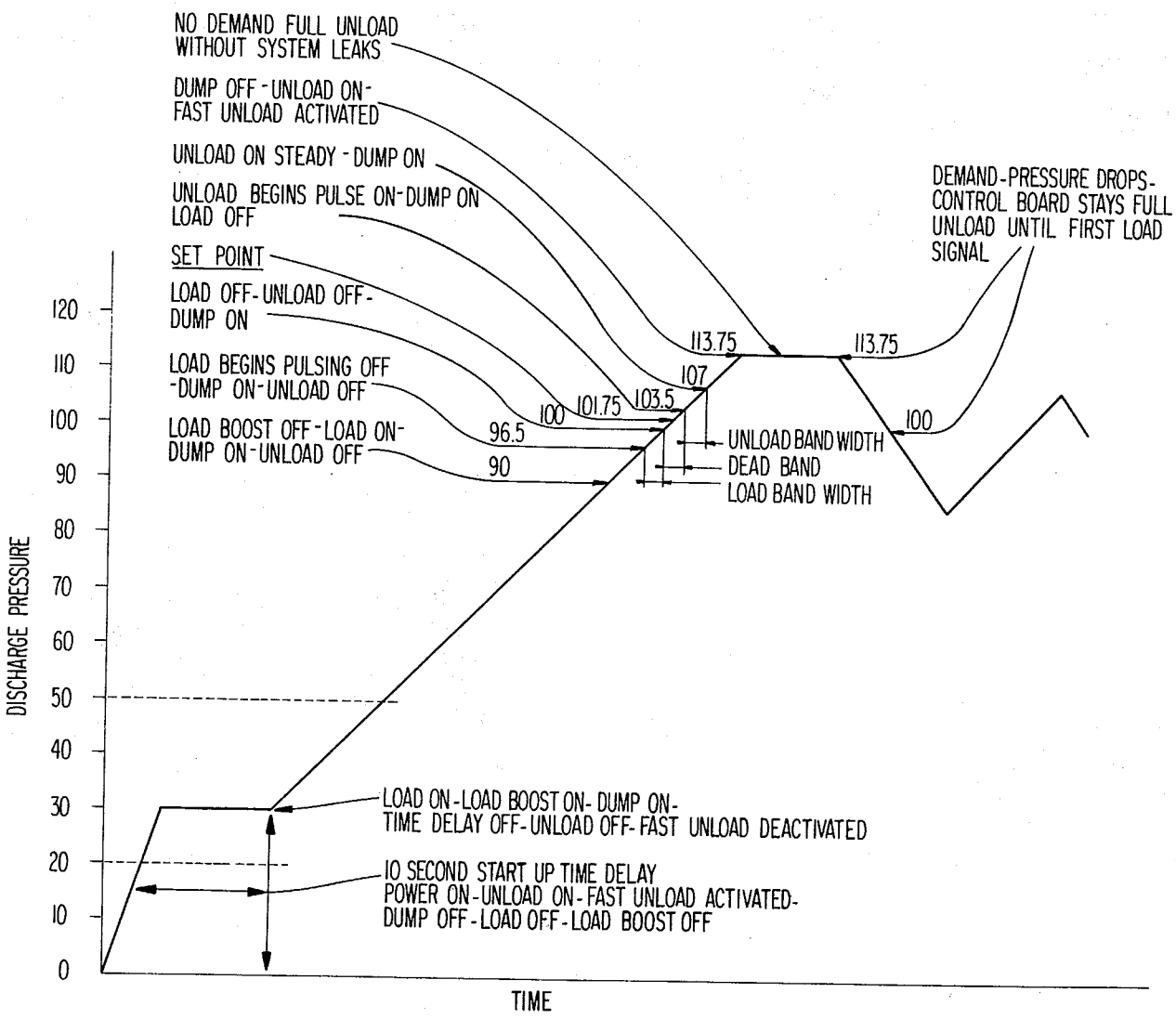
FIG. 3 is a graph showing system operation in a nominal performance curve as a function of pressure versus time.

FIG. 3 shows the sequence of operation at the load bandwidth, at which time, load pulsing is discontinued but the unload cycle remaining disabled.

During this loading, the separator dump solenoid valve remains in an on position, and pulsing occurs under the control of the electronic circuit.

For operation within a deadband range, shown in FIG. 3, the four-way solenoid valve 38 will not be pulsed, and the pressure sensed by switch 84 is within the deadband. When the pressure sensed exceeds the deadband, but within an unload bandwidth, shown in FIG. 3, an unload cycle begins. During the unload cycle, the power piston 20 is driven to the right as oil is fed into outboard section 18. During the unload cycle, oil is diverted from line 50 through port "C" of the four-way valve and into port "B" through check valve 61 and then to port 34. During this unload cycle, oil from inboard section 16 is gated from port 36 into line 74 through restrictor 72 on line 74 and then back to the "A" port of the four-way valve. This oil from inboard section 16 is then gated through the "D" port to line 68 and fed to the compressor inlet housing where it is recycled.

If the pressure exceeds a preset limit, the separator dump solenoid valve 44 will be actuated to vent the system to atmosphere. With the piston 20 driven to the right, the effective length of the screw is decreased, thereby decreasing compressor output.

It can readily be seen, therefore, that as demand in the system increases for more compressed air, the system pressure in the compressor section will decrease, thereby creating a situation requiring additional loading. Pressure is increased by increasing the effective length of the compressor through movement of the slide valve 24 to the left in a load mode until a new slide position is achieved and the system is in the deadband. Conversely, as demand for air in the system decreases, system pressure in the compressor section will increase. Unloading is then required with oil from the inboard side of the hydraulic cylinder 16 draining until a new sensed pressure/demand is realized.

Control of these functions is accomplished by means of a control circuit to now be described.

Figure 2:
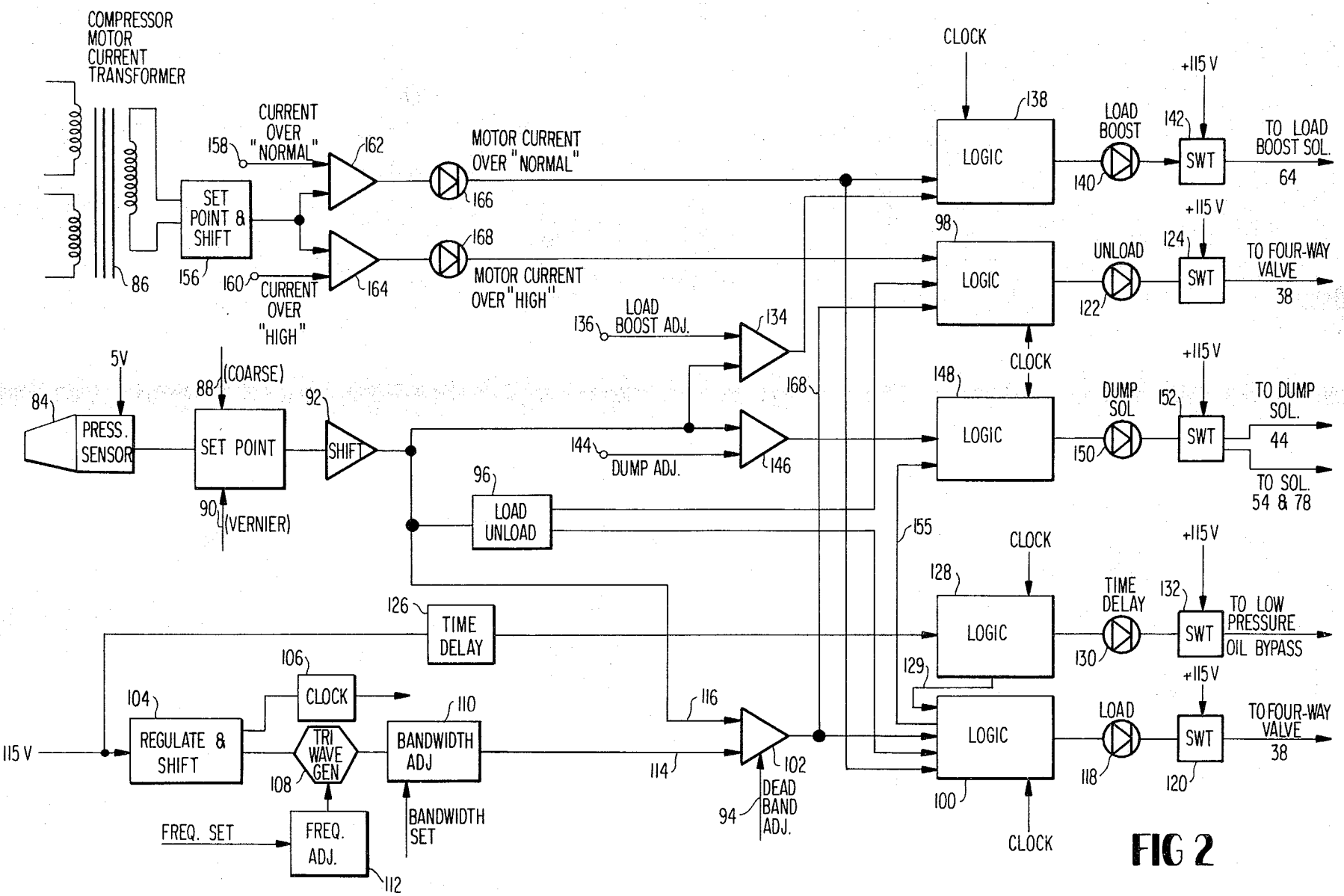
FIG. 2 is a schematic logic diagram of the electronic control portion for the operation of the system.

That control circuit is shown in FIG. 2 and basically comprises two inputs which are used as control points for the system. The first is pressure sensor 84 which is located in the environment to be controlled. Depending on the position of the sensor relative to the electronics, some compensation may be necessary to compensate for line drop which will appear as a lag in the system. This compensation can be done, for example, by a six-wire remote sensing circuit. Naturally, in remote locations, suitable environmental measures will be necessary to prevent the debilitating effects of moisture on cables, temperature variations and the like. Generally, the pressure transducer takes the form of a strain gage-type sensor which, as indicated, can be used as one arm in a bridge.

The second input is transformer 86 which is used to provide current to the compressor motor. That motor is used to drive the compressor rotor 12 and, as indicated earlier, may be minimally sized, subject to voltage brown-outs and the like. Current supply to the motor is picked-off at the transformer and used as a second input to the control network.

The pressure sensor is biased having typically a regulated voltage, for example, five volts applied to it to provide operating voltages for the subsequent amplification stages. The input signal from the pressure sensor 84 is then adjusted by means of set point adjustments 88 and 90 in a set-point resistor network. The set point adjustment represents the null point to which the compressor is always driven toward. Stated differently, the set point is the desired regulated discharge pressure of the compressor to provide an output which matches demand. Hence, in supplying control voltages to the four-way valve 38, the electronic control 81 is always seeking to drive the hydraulic piston 20 to a point where the effective length of the rotor will be such that its output effectively matches the set point discharge pressure. Two adjustments are provided: a coarse adjustment 88 and a fine or vernier adjustment 90.

The input voltage is then level shifted through a low-pass filter network to eliminate noise and fed to amplifier 92. The level shifting and amplification through circuit 92 provides a signal gain of typically, approximately 50 into the system. Hence, the signals eminating from circuit 92 will vary above or below the reference level, depending on whether or not the set point voltages are exceeded or are below that value.

Because the output voltages from stage 92 represents an algebraic voltage deviation from the set point, circuitry is needed in the system to decide whether or not the variation represents a plus voltage indicative of an unload condition or a negative voltage indicative of a load condition. Hence, load/unload circuitry 96 is provided to accomplish this function. The output of the circuitry is used to provide an additional signal to the logic networks 98 and 100 which, when taken with the output of comparator 102 which is an absolute voltage deviation from the set-point, enable the logic to determine whether or not the instrument is in a load or unload position. The logic networks can easily accomplish this function by means of setting of flip-flops during the point from initial start-up through sequential operation. Sequential flip-flop status information will indicate whether loading or unloading is to be performed.

The electronic control circuitry operates on an initial 115-volt input which is regulated and shifted in network 104. This regulated voltage is used to drive a clock 106, which is used to provide a timing input to the five logic modules shown in FIG. 2 as clock inputs so indicated. The clock input 120 hz provides the logic circuits with timing points for triggering solenoid firing at zero crossings when A.C. voltage is at a zero level, thus forming a zero crossing circuit. Generally, it is desirable to activate the solenoids at the A.C. voltage zero level, and the clock input provides this synchronization.

The regulated power input voltage is fed to a triangular wave generator 108. The triangular wave so generated is used to determine the proportional bandwidth adjustment in the network. A percentage of the triangular wave is picked-off by the bandwidth adjutment network 110, typically an adjustable arm in a resistor network. The adjustable bandwidth provides a pressure range used as an input to comparator 102, thereby modulating the set point adjustment. An adjustment of the reset frequency of the generator 108 is made in frequency adjust network 112 to provide control of the reset frequency over the bandwidth control from 0.5 to 20 seconds.

The output is fed to comparator amplifier 102, having one input 114 which represents the adjusted percentage of the triangular wave from generator 108 and the second input 116 representing the absolute output of amplifier/shift section 92. The absolute on/off output of comparator 102 is fed to logic block 100 and simultaneously applied to logic block 98 to provide input signals for the load and unload functions of the four-way valve 38. Comparator 102 has a deadband adjustment 94 to determine bandwidth, shown in FIG. 3.

In terms of basic operation in providing load and unload control signals to valve 38, logic blocks 98 and 100 provide for those control functions. Using inputs from comparator 102 and load/unload network 96, logic blocks 98 and 100 are selectively actuated to pulse four-way valve 38. The transducer output signal from 84 is proportional to sensed pressure, and as amplified in the system, is continuously compared with the set point setting, and this variation is used to control the solenoid valve 38. By means of bandwidth and deadband adjustments with the output from comparator 102, an adjustable proportional bandwidth is defined on both sides of the set point shown in FIG. 3. When this differential signal indicates that the air pressure is below the set point, logic 100 is actuated to define a loading function in four-way valve 38. This will increase the sensed pressure, driving the system back toward the set point. Conversely, when the pressure sensed in transducer 84 is above the desired set point, logic module 98 is actuated to define an unload function, thereby reducing the effective length of the compressor section and driving the system back toward the set point.

When a load function is indicated at the repetition rate as set by frequency adjustment 112, a visual indication by LED 118 is made. The output voltage used to drive the LED 118 provides an input into switch 120, which is normally open. This switch may take the form of a self-contained optical isolator phototransistor, which thereby triggers an SCR, defining a closed switch function which will provide high voltage to the four-way valve 38, or may be any other conventional switch function. For example, the output voltage can be used to drive conventional relays or the like which will provide high voltage to the four-way valve. In the load function mode, that output voltage from switch 120 is used to energize one coil of the four-way valve 38 to load the inboard section 16 of the hydraulic cylinder 14. Loading takes place by energization of one coil to allow oil from the main 48 through port "C" through the four-way valve and exiting through port "A" through restrictor 72 on line 74 and, hence, connected to port 36 feeding inboard end 16. During the load function, oil is then fed into the inboard end, driving power piston 20 to the left in a load position. Oil from chamber 18 is dumped through line 34 through the four-way valve into the compressor inlet housing.

In an unload mode, logic network 98 provides a visual indication through LED 122 and a voltage to set a switch 124, providing high voltage to the four-way valve 38. The same switch techniques can be used as in the load mode. In an unload cycle, power to four-way valve 38 is used to energize a second coil to define an unload mode where the piston 20 is driven to the right, thereby decreasing the effective length of the compressor rotor 12. In this mode, oil from main 48 is fed through the "C" port through the four-way valve through the "B" port through restrictor 62 into line 52 and into port 34 feeding output end 18. Oil from the inboard side 16 is dumped from line 36 through the four-way valve on line 68 to the compressor inlet housing.

To minimize cycling of the four-way valve, a deadband is provided about the set point so that when pressures are within the deadband range, the solenoid 38 will not be pulsed. Within the deadband, a condition exists where the pressure load remains in a steady state. A deadband input 94 to comparator 102 is made to set this deadband.

Under start-up conditions, after power has been turned on to the compressor and operative power is supplied to the control board, a time delay circuit 126 is used to provide a fixed time delay for driving the piston 20 in an unload mode. The time delay network basically comprises a capacitor which slowly charges and is completely discharged by means of a diode each time the power is turned off. When power is applied to the system, the time delay network will slowly charge, providing an input signal to logic 128. The initial output will actuate LED 130 and provide an output for closing switch member 132, thereby bypassing a low-pressure shut-off valve that is used to normally lock the compressor "off". During this period of time, the four-way valve 38 is actuated to unload the slide valve member in the manner consistent with the fast-unload operation previously discussed. As shown in FIG. 3, during this 10-second start-up delay period following a power-on condition, the slide valve is driven in an unload direction with a fast unload actuated. Hence, during this 10-second period, solenoids 54 and 78 are additionally open to provide a complete venting of the system to drive the slide valve 24 to a complete unload position. During this period, a signal is developed on line 129 to logic module 100 to inhibit loading.

Following the 10-second delay, the system cycles to a load condition, and load logic 100 is actuated to define a normal load on the compressor until it matches or approaches the set point. Under those conditions, the pressure sensed is below the set point pressure, and the absolute voltage output from shift and set circuit 92 is fed into a load boost comparator 134. The comparator uses a fixed load boost adjustment setting 136 which defines a maximum pressure to initiate a load boost sequence. If the initial pressure does not exceed the preset maximum, the output of comparator 34 is fed to logic 138 to initiate a load boost sequence. Output from logic 138 provides a visual indication on LED 140 and a voltage to trigger switch 142. Similar switch functions can be used for switch 142 as previously indicated. The output of switch 142 applies high voltage to the load boost solenoid 64. By actuation of the normally closed load boost solenoid valve 64, oil vented from outboard end 18 is fed through the "B" port of the four-way valve through the "A" port and added to the oil from main line 50 through duct 74 and then to port 36 feeding the inboard end 16. Hence, a boost in loading occurs to decrease the load cycle time. Hence, it can be seen that following the 10-second delay, both the load logic 100 and load boost logic 138 are respectively actuated to provide loading of the system as shown in FIG. 3.

Conversely, the system provides for dumping of pressure in the separator if the pressure sensed by pressure sensor 84 exceeds a preset amount above the set point. The preset amount is generally in the range of 5–10 psi above the set point and is generated in the system by means of dump adjustment 144. The output from the shift and amplification circuit 92, while applied to the boost adjustment comparator 34, is also applied to the dump comparator 146. When the pressure sensed from the output of amplifier 92 exceeds the set dump adjustment pressure 144, logic network 148 is actuated. A visual indication by LED 150 occurs and triggers switch 152. This switch is normally closed to provide power to the solenoid. For purposes of safety, the dump solenoid 44 is normally energized to hold in closed position. In case of general power failure, the solenoid will open, providing complete dumping. By actuation of switch 152, the normally energized solenoid 44 is de-energized, thereby opening valve 154 to dump the pressure to atmosphere. In such a mode, pressure in the separator tank is relieved until a reduction occurs below the pressure set forth in dump adjustment 144. Simultaneously, a fast-unload cycle is actuated by opening valves 54 and 78. This will bypass the four-way valve 38 and drive piston 20 to the right to unload the compressor as pressure is relieved in the system. Hence, upon start-up, compressor output will be in the same range as residual system line pressure.

Prior to actuation of the dump solenoid, the control circuit is generally pulsing the four-way solenoid valve 38 to unload the slide valve 24. Because the dump adjustment pressure is set into the control circuit, the dump solenoid will remain opened and de-energized until the pressure has been reduced to below the set-point 144 and until a first load pulse is received along line 155. At this pressure reduction level, the dump solenoid is reset, with the control circuit again pulsing solenoid 38 in a load mode which will reset the dump logic by means of signal which appears along line 155. The signal eminates from the load logic 100 in the form of a reset pulse to reset the dump logic 148.

The control circuit also receives an input in the form of current from the compressor drive motor. Current from transformer 86 is fed to a set point and shift network 156 for purposes of referencing all signals to the five-volt potential level. Two adjustable motor current control set points are established. The first set point 158 is indicative of when the motor current is above a normal point established directly from operational limits of the compressor motor. The second set point 160 is indicative of a current limit above the normal current load requirements. Essentially, the "normal" level set in at point 158 would be the 100% motor current limit as established by the normal operating limits for the compressor motor. The "high" point is generally established at being in the range of 104% of motor current limit.

The signal adjusted from circuit 156 is split and fed to two comparators 162 and 164. When the sensed current exceeds the "normal" value, an output from comparator 162 is used to provide a visual indication by LED 166 of motor current being above the established normal limits. This signal is fed to logic block 138 and to block 100 along line 168. A signal from comparator 162 inhibits logics 100 and 138 such that no loading of the four-way solenoid valve 38 can occur in either a normal load mode or in a load boost mode. Hence, the control circuit is limited by a signal from comparator 162 to controlling the slide valve 24 in an unload direction only. Pulsing occurs, therefore, only in the unload direction.

Similarly, a signal from comparator 164 indicates that the motor current has exceeded the "high" value and provides a visual indication along LED 168. The signal is fed to logic block 98 which actuates the four-way solenoid valve 38 to sequencing previously defined to force the slide valve 24 in the unload direction. Unloading occurs until sensed motor current used to drive the compressor is reduced below the "normal" set point. By this technique, the control circuit monitors not only air pressure in the system but also motor current used to drive the compressor rotor. Active control over the solenoid valve, therefore, occurs to match loading to not only pressure demands but also the capacity of the motor drive.

Accordingly, it can be seen that by electronic control, the four-way solenoid and ancillary equipment is driven in response to pressure sensed at the air header 42 to dynamically control the compressor in response to real time requirements. Those real time requirements are also monitored vis-a-vis the motor current demand such that brown-out or motor failure is avoided by relieving the compressor motor of its loading requirements when set current values are exceeded. It is readily apparent that the logic functions can be sequentially built up utilizing standard logic modules, such as the Texas Instruments TTL series, for example, TTL4013 logic modules in the logic networks 98, 100, 128, 138 and 148 and TTL series 78MO8VC and 78LO5AWC in the power regulator section. Also, all LED indicator functions are grouped on a control panel. Set adjustments are made at the panel. Modifications can be made without departing from the essential aspects of the system.

Also, this system is applicable to a refrigeration system where opposite load/unload conditions exist. By reversing functions, the system can unload the compressor on pressure drops, thereby performing the same electronic control albeit in a complete reversal of operations. This system will also find direct application in heat controlling where unloading takes place at temperature increases with corresponding pressure rises.

Having described this invention,

We claim:

1. In a screw air compressor system having a compressor section, a motor for driving said rotors, an output reservoir for compressed air and an output line associated with said reservoir, a slide valve movable relative to said compressor rotors for varying the output of said section and a hydraulic piston and cylinder assembly, said piston dividing said cylinder into an inboard and an outboard section and coupled to said side valve, the improvement comprising:

an input source of hydraulic fluid;

valve means connected to said cylinder assembly, wherein said valve means has four ports, a first port selectively engageable for receiving hydraulic fluid from said input source, a second port selectively engageable with the outboard section of said cylinder assembly, a third port selectively engageable with the inboard section of said cylinder assembly, a fourth port selectively engageable with a drain line and means on said valve means for effecting the opening and closing of said ports;

means for sensing the output air pressure in said output line;

means for sensing input loading of said motor;

a control circuit coupled to said valve means and responsive to both said means for sensing pressure and said means for sensing input loading to selectively pulse said valve means to thereby move said piston and vary the output of said compressor; and a two-way coupling between said second port and said outboard section, said two-way coupling defining a first flow path through a restrictor section from said second port to said outboard section and a second flow path parallel to said first path and having a boost valve therein, whereby when said boost valve is open, fluid communication from said outboard section to said second port is established.

2. In a screw air compressor system having a compressor section, a motor for driving said rotors, an output reservoir for compressed air and an output line associated with said reservoir, a slide valve movable relative to said compressor rotors for varying the output of said section and a hydraulic piston and cylinder assembly, said piston dividing said cylinder into an inboard and an outboard section and coupled to said side valve, the improvement comprising:

an input source of hydraulic fluid;

valve means connected to said cylinder assembly, wherein said valve means has four ports, a first port selectively engageable for receiving hydraulic fluid from said input source, a second port selectively engageable with the outboard section of said cylinder assembly, a third port selectively engageable with the inboard section of said cylinder assembly, a fourth port selectively engageable with a drain line and means on said valve means for effecting the opening and closing of said ports;

means for sensing the output air pressure in said output line;

means for sensing input loading of said motor;

a control circuit coupled to said valve means and responsive to both said means for sensing pressure and said means for sensing input loading to selectively pulse said valve means to thereby move said piston and vary the output of said compressor; and a two-way coupling between said third port and said inboard section, said two-way coupling defining a first flow path through a restrictor section from said third port to said inboard section and a second flow path parallel to said first path and having a check valve therein providing further communication between said third port and said inboard section.

3. In a screw air compressor system having a compressor section, a motor for driving said rotors, an output reservoir for compressed air and an output line associated with said reservoir, a slide valve movable relative to said compressor rotors for varying the output of said section and a hydraulic piston and cylinder assembly, said piston dividing said cylinder into an inboard and an outboard section and coupled to said side valve, the improvement comprising:

an input source of hydraulic fluid;

valve means connected to said cylinder assembly, wherein said valve means has four ports, a first port selectively engageable for receiving hydraulic fluid from said input source, a second port selectively engageable with the outboard section of said cylinder assembly, a third port selectively engageable with the inboard section of said cylinder assembly, a fourth port selectively engageable with a drain line and means on said valve means for effecting the opening and closing of said ports;

means for sensing the output air pressure in said output line;

means for sensing input loading of said motor;

a control circuit coupled to said valve means and responsive to both said means for sensing pressure and said means for sensing input loading to selectively pulse said valve means to thereby move said piston and vary the output of said compressor; and an overload circuit responsive to input loading of said motor, said circuit overload providing a first output signal inhibiting movement of said piston in one direction if a first predetermined level of input loading is exceeded, and a second output signal driving said piston in a second duration if a second predetermined level of input loading is exceeded.

4. In a screw air compressor system having a compressor section, a motor for driving said rotors, an output reservoir for compressed air and an output line associated with said reservoir, a slide valve movable relative to said compressor rotors for varying the output of said section and a hydraulic piston and cylinder assembly, said piston dividing said cylinder into an inboard and an outboard section and coupled to said side valve, the improvement comprising:

an input source of hydraulic fluid;

valve means connected to said cylinder assembly, wherein said valve means has four ports, a first port selectively engageable for receiving hydraulic fluid from said input source, a second port selectively engageable with the outboard section of said cylinder assembly, a third port selectively engageable with the inboard section of said cylinder assembly, a fourth port selectively engageable with a drain line and means on said valve means for effecting the opening and closing of said ports;

means for sensing the output air pressure in said output line;

means for sensing input loading of said motor;

a control circuit coupled to said valve means and responsive to both said means for sensing pressure and said means for sensing input loading to selectively pulse said valve means to thereby move said piston and vary the output of said compressor; and means selectively coupled from said source of hydraulic fluid to said outboard section to drive said piston and slide valve in one direction without pulsing said valve means.

5. The system of claim 4 wherein said means selectively coupled includes a feed line from said source to said outboard section and an unload valve interposed in said feed line.

6. The system of claim 5 wherein said unload valve is operative in response to signals from said control circuit.

7. The system of claim 4 further including means selectively coupled from said inboard section to said drain line to drain hydraulic fluid from said inboard section to said drain line without pulsing said valve means when said piston is driven in said one direction.

8. The system of claim 7 wherein said piston is driven to unload said compressor system by decreasing the effective length of said compressor section.

9. The system of claim 4 wherein said control circuit includes means responsive to said sensed pressure to establish a sensor input signal, means to set a predetermined maximum level signal indicative of maximum allowable system pressure, comparator means responsive to said input signal and said maximum level signal to generate an output signal when said maximum level is exceeded, and logic means responsive to said output signal to actuate a valve on said reservoir to dump air to atmosphere.

10. The system of claim 4 wherein said control circuit includes means responsive to said sensed pressure to establish a sensor input signal, means to adjust said input signal to a predetermined reference point, and means responsive to said adjusted signal to determine the sense of said adjusted signal.

11. In a screw air compressor system having a compressor section, a motor for driving said rotors, an output reservoir for compressed air and an output line associated with said reservoir, a slide valve movable relative to said compressor rotors for varying the output of said section and a hydraulic piston and cylinder assembly, said piston dividing said cylinder into an inboard and an outboard section and coupled to said side valve, the improvement comprising:

an input source of hydraulic fluid;

valve means connected to said cylinder assembly, wherein said valve means has four ports, a first port selectively engageable for receiving hydraulic fluid from said input source, a second port selectively engageable with the outboard section of said cylinder assembly, a third port selectively engageable with the inboard section of said cylinder assembly, a fourth port selectively engageable with a drain line and means on said valve means for effecting the opening and closing of said ports;

means for sensing the output air pressure in said output line;

means for sensing input loading of said motor;

a control circuit coupled to said valve means and responsive to both said means for sensing pressure and said means for sensing input loading to selectively pulse said valve means to thereby move said piston and vary the output of said compressor;

said control circuit including means responsive to said sensed pressure to establish a sensor input signal, means to adjust said input signal to a predetermined reference point, and means responsive to said adjusted signal to determine the sense of said adjusted signal;

first and second logic means, the output of said means to determine the sense of said adjusted signal used as one input to each of said first and second logic means, means for establishing a signal bandwidth, comparator means responsive to said bandwidth signal and said adjusted input signal to deliver a second input signal to said first and second logic means when said bandwidth is exceeded, said first logic means selectively responsive to said first and second inputs to actuate said valve means for driving said piston in one direction when said adjusted input signal exceeds said predetermined reference point, and said second logic means selectively responsive to said first and second inputs to actuate said valve means for driving said piston in a second direction when said adjusted input signal does not exceed said predetermined reference point.

12. The system of claim 11 further including means to establish a reference signal indicative of a boost level of compressor output, comparator responsive to said adjusted input signal and said reference signal for producing an output signal to third logic means, said third logic means actuating a boost valve to establish fluid communication between said outboard section of said cylinder assembly and said valve means.

13. The system of claim 11 wherein said first logic means generates a signal to pulse said valve means to establish a first path of fluid communication from an input source of hydraulic fluid through said valve means to said outboard section, said first path of fluid communication having a flow restrictor section, and second path of fluid communication between said inboard section through said valve means to a drain line, whereby said piston moves in a first direction unloading said compressor.

14. The system of claim 11 wherein said second logic means generates a signal to pulse said valve means to establish a first path of fluid communication from an input source of hydraulic fluid through said valve means to said inboard section, said first path of fluid communication having a flow restrictor section, and a second path of fluid communication between said outboard section through said valve means to a drain line, whereby said piston moves in a second direction loading said compressor.

15. The system of claim 11 further including means responsive to input loading of said motor to derive a current output signal, first and second comparators responsive to said current output signal, said first comparator having a fixed reference signal indicative or maximum motor current as a second input to said first comparator, said second comparator having a fixed reference signal indicative of a predetermined limit of motor current as a second input to said second comparator, said first comparator generating an output signal when said first input exceeds said second input and supplied to said second logic means to inhibit pulsing of said valve means and preventing said piston from being driven in said second direction, said second comparator generating an output signal when said first input exceeds said second input and supplied to said first logic means to initiate pulsing of said valve means until said current input signal is below a predetermined value.

16. The system of claim 15 wherein said output signal from said first comparator is supplied to third logic means to inhibit actuation of a boost valve establishing fluid communication between said outboard section and said valve means.

17. The system of claim 12 further including a comparator having a first input in the form of a fixed reference indicative of maximum system air pressure and said adjusted signal as a second input, said comparator delivering an output signal to fourth logic means when said second input exceeds the first, whereby said logic causes a valve to be opened dumping air pressure from said system until said adjusted signal is below a predetermined value.

18. The system of claim 17 further including means responsive to said fourth logic means to establish a first path of fluid communication from a source of hydraulic fluid to said outboard section and a second path of fluid communication from said inboard section to a drain line to cause said piston to move in said first direction and to unload said compressor section.

19. The system of claim 18 wherein said control circuit includes a time delay circuit, said time delay circuit actuated upon initiation of power to said motor to provide an output signal of limited duration to fifth logic means for driving said piston in a first direction to unload said compressor section.

20. The system of claim 19 wherein said fifth logic means provides an output signal to said second logic means to inhibit loading of said compressor during said limited duration.

21. In a screw air compressor system having a compressor section, a motor for driving said rotors, an output reservoir for compressed air and an output line associated with said reservoir, a slide valve movable relative to said compressor rotors for varying the output of said section and a hydraulic piston and cylinder assembly, said piston dividing said cylinder into an inboard and an outboard section and coupled to said slide valve, the improvement comprising:

valve means connected to said cylinder assembly;

means for sensing the output air pressure in said output line and for developing a signal related thereto;

means for sensing input loading of said motor; and a control circuit responsive to both said means for sensing pressure and said means for sensing input loading to selectively pulse said valve means to thereby move said piston and vary the output of said compressor;

said control circuit comprising means for developing a regulated signal;

means for adjustably modulating said regulated signal to provide a predetermined pressure signal, said adjustable modulation causing said predetermined pressure signal to have an adjustable system reset rate, an adjustable pressure bandwidth, and an adjustable pressure dead band; and means for comparing said air pressure related signal to said predetermined pressure signal.

22. The system of claim 21, wherein said adjustable modulating means includes frequency modulating means to effect an adjustment of said system reset rate.

23. The system of claim 21, wherein said adjustable modulating means includes amplitude modulating means to effect an adjustment of said pressure dead band and said pressure bandwidth.

24. The system of claim 21, wherein said means for developing a signal related to the output air pressure includes means for adjusting the system pressureset point.

25. The system of claim 21 further including a time delay circuit associated with said control circuit, said time delay circuit actuated upon initiation of power to said motor to provide an output signal of limited duration for driving said piston in a first direction to unload said compressor section.

26. The system of claim 21 wherein said control circuit includes means responsive to a predetermined air pressure level and said sensed output air pressure to provide an output signal driving said piston in one direction to unload said compressor when said predetermined level has been exceeded.

27. The system of claim 21 wherein said control circuit includes comparator means responsive to sensed pressure and a predetermined bandwidth to selectively pulse said valve means.

* * * * *